US007055607B2

(12) United States Patent
Jacob

(10) Patent No.: US 7,055,607 B2
(45) Date of Patent: Jun. 6, 2006

(54) SEAL ASSEMBLY FOR A SAFETY VALVE

(75) Inventor: Jean-Luc Jacob, Poey de Lescar (FR)

(73) Assignee: Weatherford/Lamb, Inc., Houston, TX (US)

( * ) Notice: Subject to any disclaimer, the term of this patent is extended or adjusted under 35 U.S.C. 154(b) by 280 days.

(21) Appl. No.: 10/779,478

(22) Filed: Feb. 13, 2004

(65) Prior Publication Data

US 2005/0178559 A1 Aug. 18, 2005

(51) Int. Cl.
*E21B 33/128* (2006.01)

(52) U.S. Cl. ..... 166/375; 166/126; 166/187

(58) Field of Classification Search ..... 166/126, 166/187, 375

See application file for complete search history.

(56) References Cited

U.S. PATENT DOCUMENTS 4,340,088 A * 7/1982 Geisow ..... 137/629
4,420,043 A * 12/1983 Brooks ..... 166/319
4,428,557 A * 1/1984 Yonker et al. ..... 251/62
4,691,776 A 9/1987 Pringle
4,729,433 A 3/1988 Jacob
4,834,175 A * 5/1989 Ross et al. ..... 166/120
5,305,828 A * 4/1994 White et al. ..... 166/120
5,586,601 A * 12/1996 Pringle ..... 166/212

FOREIGN PATENT DOCUMENTS

GB 2 190 941 12/1987

OTHER PUBLICATIONS

U.K. Search Report, Application No. GB0502967.3, dated Jun. 7, 2005.

* cited by examiner

*Primary Examiner*—Frank S. Tsay
(74) *Attorney, Agent, or Firm*—Patterson & Sheridan, L.L.P.

(57) ABSTRACT

Methods and apparatus for sealing a safety valve within a tubular that the safety valve is designed to be landed and set in are disclosed. The valve includes a seal assembly having a seal on the valve that is acted on by a first piston disposed on a first side of the seal and/or a second piston disposed on a second side of the seal. Wellbore fluid pressure acts on the first piston when the valve is closed, thereby moving the first piston to force the seal into sealing contact with an inside surface of the tubular. When the safety valve is actuated open, fluid pressure from a control line acts on the second piston and moves the second piston to force the seal into sealing contact with the inside surface of the tubular. The seal may include a plurality of chevron seals on each side of a sealing element.

26 Claims, 4 Drawing Sheets

SEAL ASSEMBLY FOR A SAFETY VALVE

BACKGROUND OF THE INVENTION

1. Field of the Invention

Embodiments of the invention generally relate to safety valves disposed concentrically within a tubular. More particularly, embodiments of the invention relate to a subsurface safety valve having a seal assembly to seal an annulus between the outside of the valve and the tubular.

2. Description of the Related Art

Surface-controlled, subsurface safety valves (SCSSVs) are commonly used to shut-in oil and gas wells. The SCSSV fits into a production tubing in a hydrocarbon producing well and operates to block the flow of formation fluid upwardly through the production tubing should a failure or hazardous condition occur at the well surface. The production tubing may include a ported landing nipple designed to receive the SCSSV therein such that the SCSSV may be installed and retrieved by wireline. During conventional methods for run-in of the SCSSV to the landing nipple, a tool used to lock the SCSSV in place within the nipple also temporarily holds the SCSSV open until the SCSSV is locked in place.

Most SCSSVs are "normally closed" valves, i.e., the valves utilize a flapper type closure mechanism biased to a closed position. During normal production, application of hydraulic fluid pressure transmitted to an actuator of the SCSSV maintains the SCSSV in an open position. A control line that resides within the annulus between the production tubing and a well casing may supply the hydraulic pressure to a port in the nipple that permits fluid communication with the actuator of the SCSSV. In many commercially available SCSSVs, the actuator used to overcome the bias to the closed position is a hydraulic actuator that may include a rod piston or concentric annular piston. During well production, the flapper is maintained in the open position by a flow tube acted on by the piston to selectively open the flapper member in the SCSSV. Any loss of hydraulic pressure in the control line causes the piston and actuated flow tube to retract, which causes the SCSSV to return to the normally closed position. Thus, the SCSSV provides a shutoff of production flow once the hydraulic pressure in the control line is released. The bias to the normally closed position may be caused by a powerful spring and/or gas charge that biases the actuator and a torsion spring and a response to upwardly flowing formation fluid that causes the flapper to rotate about a hinge pin to the closed position.

The landing nipple within the production tubing may become damaged by operations that occur through the nipple prior to setting the SCSSV in the landing nipple. For example, operations such as snubbing and tool running using coiled tubing and slick line can form gouges, grooves, and/or ridges along the inside surface of the nipple as the operations pass through the nipple. Further, any debris on the inside surface of the nipple or any out of roundness of the nipple may prevent proper sealing of the SCSSV within the nipple. Failure of the SCSSV to seal in the nipple due to surface irregularities in the inner diameter of the nipple can prevent proper operation of the actuator to open the SCSSV and can prevent the SCSSV from completely shutting-in the well when the SCSSV is closed since fluid can pass through the annular area between the SCSSV and the nipple due to the irregularities. Operating the well without a safety valve or with a safety valve that does not function properly presents a significant danger. Thus, the current solution to conserve the safety in wells having damaged nipples includes an expensive and time consuming work over to replace the damaged nipples.

Therefore, a need exists for an apparatus and method for disposing an SCSSV within a tubular having a damaged or irregular inside surface. There exists a further need for an SCSSV that can be set and sealed within a damaged landing nipple using conventional methods. Further, a need exists for an SCSSV that provides a large inner diameter flow path while sealing an annulus between the outside of the SCSSV and an irregular inner surface of a landing nipple.

SUMMARY OF THE INVENTION

The invention generally relates to a seal assembly for a safety valve designed to be landed and set within a tubular member. The seal assembly includes a seal on the safety valve that is acted on by a first piston disposed on a first side of the seal and/or a second piston disposed on a second side of the seal. Wellbore fluid pressure acts on the first piston when the safety valve is closed, thereby moving the first piston to force the seal into sealing contact with an inside surface of the tubular member. When the safety valve is actuated open, fluid pressure from a control line acts on the second piston and moves the second piston to force the seal into sealing contact with the inside surface of the tubular member. The seal may include a plurality of chevron seals on each side of a sealing element.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The invention generally relates to a seal assembly for any type of safety valve designed to be landed and set within a tubular member. The safety valve may be a hydraulically operated surface controlled, subsurface safety valve (SCSSV). One of ordinary skill in the art of subsurface safety valves will appreciate that various embodiments of the invention can and may be used in all types of subsurface safety valves designed for landing in a ported nipple, including but not limited to wireline retrievable valves, subsurface controlled valves, flapper type valves, and concentric type valves. Further, any type of actuator initiated by hydraulic fluid pressure (e.g. a rod piston actuator or an annular concentric piston) supplied to the SCSSV may be used to perform the actual opening of the SCSSV.

Figure 1:
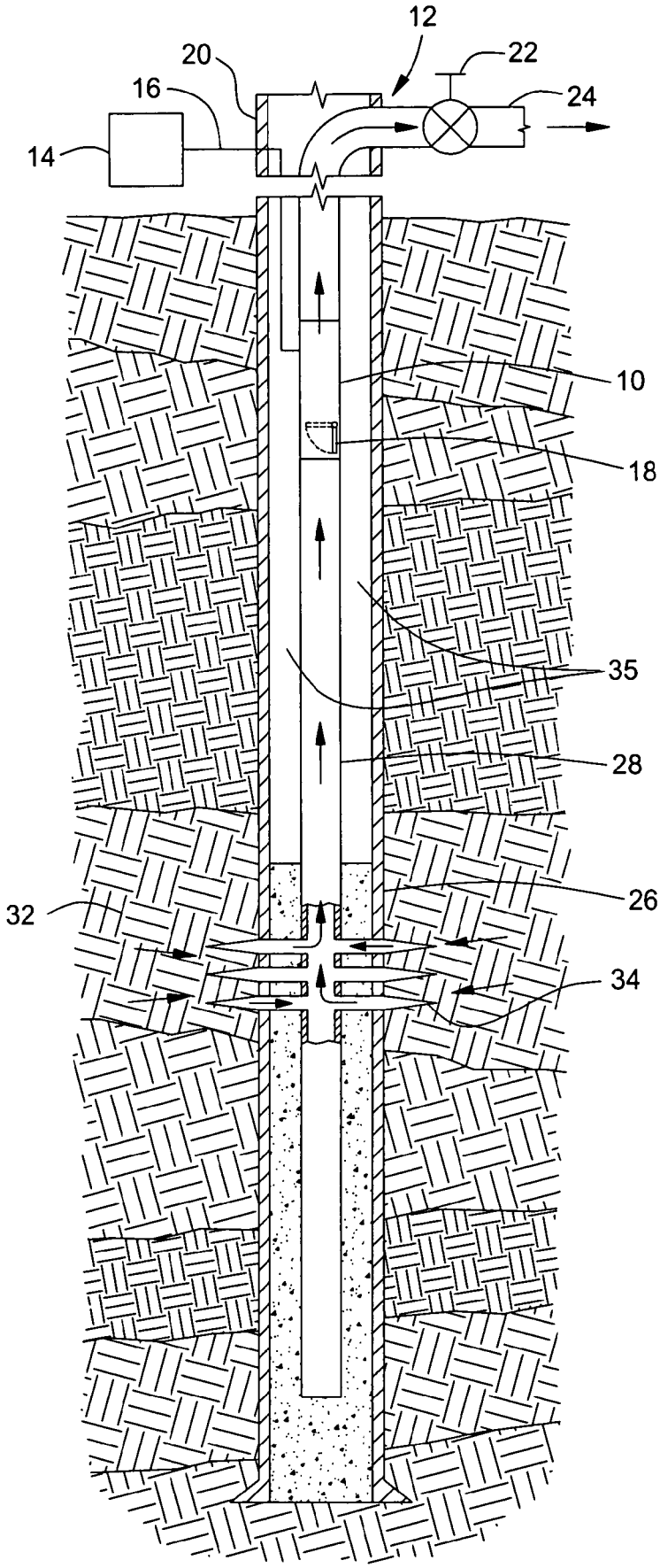
FIG. 1 is a schematic of a production well having a surface controlled, subsurface safety valve (SCSSV) installed therein.

FIG. 1 illustrates a production well 12 having an SCSSV 10 installed therein according to aspects of the invention as will be described in detail herein. While a land well is shown for the purpose of illustration, the SCSSV 10 may also be used in offshore wells. FIG. 1 further shows a wellhead 20, surface equipment 14, a master valve 22, a flow line 24, a casing string 26 and a production tubing 28. In operation, opening the master valve 22 allows pressurized hydrocarbons residing in the producing formation 32 to flow through a set of perforations 34 that permit and direct the flow of hydrocarbons into the production tubing 28. Hydrocarbons (illustrated by arrows) flow into the production tubing 28 through the SCSSV 10, through the wellhead 20, and out into the flow line 24. The SCSSV 10 is conventionally set in a profile within the production tubing 28. Surface equipment 14 may include a pump, a fluid source, sensors, etc. for selectively providing hydraulic fluid pressure to an actuator (not shown) of the SCSSV 10 in order to maintain a flapper 18 of the SCSSV 10 in an open position. A control line 16 resides within the annulus 35 between the production tubing 28 and the casing string 26 and supplies the hydraulic pressure to the SCSSV 10.

Figure 2:
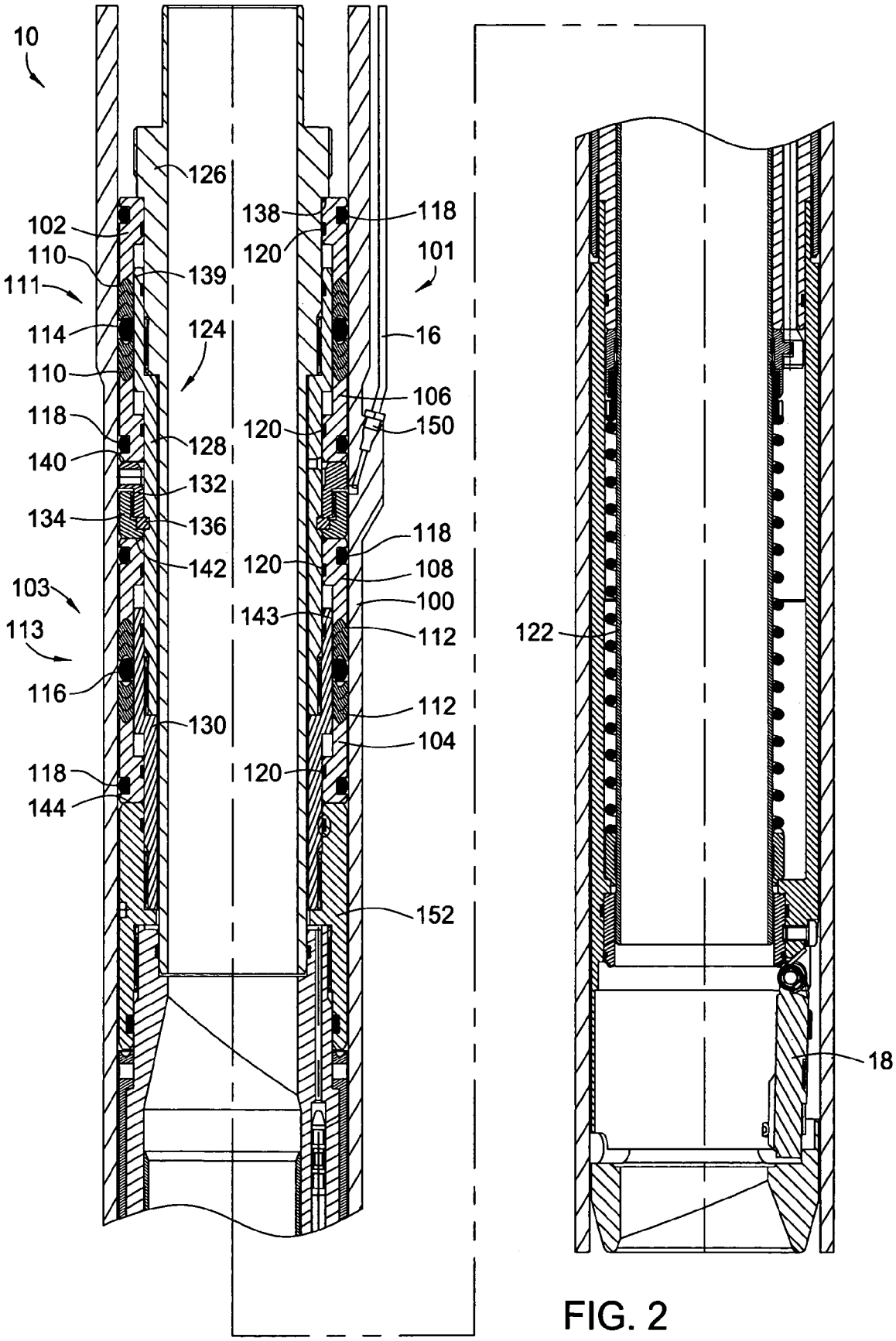
FIG. 2 is a sectional view of the SCSSV within a landing nipple during run-in of the SCSSV illustrating seal assemblies of the SCSSV in an uncompressed position.

FIG. 2 illustrates a sectional view of the SCSSV 10 within a landing nipple 100 in the production tubing. The SCSSV 10 is shown in a run-in position prior to setting of the SCSSV 10 within the landing nipple 100. As shown, the SCSSV 10 includes an upper and a lower seal assembly 101, 103 around an outside thereof, a packing mandrel 124 disposed inside the seal assemblies 101, 103 and an actuator/spring housing 152 connected to the lower end of the packing mandrel 124. The upper seal assembly 101 includes an upper compressible seal 111 formed by an upper sealing element 114 located between concave portions of upper V-seals or chevrons 110 on each side of the upper sealing element 114, an upper first piston 102 in contact with a top of the chevrons 110, and an upper second piston 106 in contact with a bottom of the chevrons 110. Similarly, the lower seal assembly 103 includes a lower compressible seal 113 formed by a lower sealing element 116 located between concave portions of lower V-seals or chevrons 112 on each side of the lower sealing element 116, a lower first piston 104 in contact with a bottom of the chevrons 112, and a lower second piston 108 in contact with a top of the chevrons 112. The pistons 102, 106, 108, 104 are preferably annular or concentric pistons. While both the upper and lower seal assemblies 101, 103 are shown in the embodiment in FIG. 2, the SCSSV 10 may include only one of either the upper or lower seal assemblies 101, 103. Additionally, other variations of the seals 111, 113 may be used so long as the pistons 102, 106, 108, 104 can operate to force the seals 111, 113 into sealing contact with the nipple 100.

The packing mandrel 124 includes an upper sub 126, a middle sub 128, and a lower sub 130 connected together such as by threads. However, the packing mandrel 124 may be made from an integral member or any number of subs. An annular shoulder 138 on the upper sub 126 provides a decompression stop for the upper first piston 102, which is slidable along a portion of an outer diameter of the upper sub 126. The upper compressible seal 111 located proximate to an increased outer diameter portion 139 of the middle sub 128 seals against the increased outer diameter portion 139. Additionally, the increased outer diameter portion 139 on the middle sub 126 provides a compression stop for both the upper first and second pistons 102, 106. A snap ring 136 fixed relative to the middle sub 126 engages a portion of an upper nut 132 connected to a lower nut 134 to secure the nuts 132, 134 relative to the middle sub. The upper and lower nuts 132, 134 located between the second pistons 106, 108 operate to longitudinally separate the upper and lower seal assemblies 111, 113. Thus, a face 140 of the upper nut 132 provides a decompression stop for the upper second piston 106 and a face 142 of the lower nut 134 provides a decompression stop for the lower second piston 108. Both the upper and lower second pistons 106, 108 are slidable along portions of the outer diameter of the middle sub 128 on each side of the nuts 132, 134. The lower compressible seal 113 located proximate to an increased outer diameter portion 143 of the lower sub 130 seals against the increased outer diameter portion 143. Additionally, the increased outer diameter portion 143 on the middle sub 126 provides a compression stop for both the lower first and second pistons 108, 104. An end face 144 of the actuator/spring housing 152 provides a decompression stop for the lower first piston 104.

The compression and decompression stops operate to limit the sliding movement of the pistons 102, 106, 108, 104 of the sealing assemblies 101, 103. Inner seals 120 on the inside of the pistons 102, 106, 108, 104 provide a seal between each piston and the packing mandrel 124 that the pistons slide along. Outer seals 118 on the outside of the pistons 102, 106, 108, 104 provide an initial seal between each piston and the nipple 100. The outer seals 118 may be soft o-rings with a large cross section to help ensure a sufficient initial seal between the pistons 102, 106, 108, 104 and the nipple 100. Thus, the initial seal provided by the outer seals 118 sufficiently seals against the nipple 100 such that fluid pressure applied to the large surface areas of the pistons 102, 106, 108, 104 that are shown in contact with the decompression stops 138, 140, 142, 144 causes the pistons to slide along the packing mandrel 124 toward the respective seal 111, 113.

In the run in position of the SCSSV 10 as shown in FIG. 2, the seal assemblies 101, 103 are in uncompressed positions with all the pistons 102, 106, 108, 104 contacting their respective decompression stops 138, 140, 142, 144. Therefore, the upper and lower seals 111, 113 are not compressed and may not provide sealing contact with the inside surface of the nipple 100 and the outside of the packing mandrel 124. During run-in all parts of the SCSSV 10 are in equal pressure so that the pistons 102, 106, 108, 104 do not move. In the run-in position, the SCSSV 10 is temporarily held open by a running tool (not shown) using a run-in prong or other temporary opening member. Since the SCSSV 10 is open, wellbore fluid pressure does not act on the first pistons 102, 104 to compress the upper and lower seals 111, 113. Further, fluid pressure is not supplied through the control line 16 such that the second pistons 102, 106 are also not acted on to compress the upper and lower seals 111, 113.

Once the SCSSV 10 is set or locked in the nipple 100 by conventional methods, the temporary opening member disengages and permits normal functioning of the SCSSV 10. Thus, the flapper 18 biases to a closed position unless fluid pressure is supplied through the control line 16 to a port 150 in the nipple 100 in order to actuate the SCSSV 10.

Figure 3:
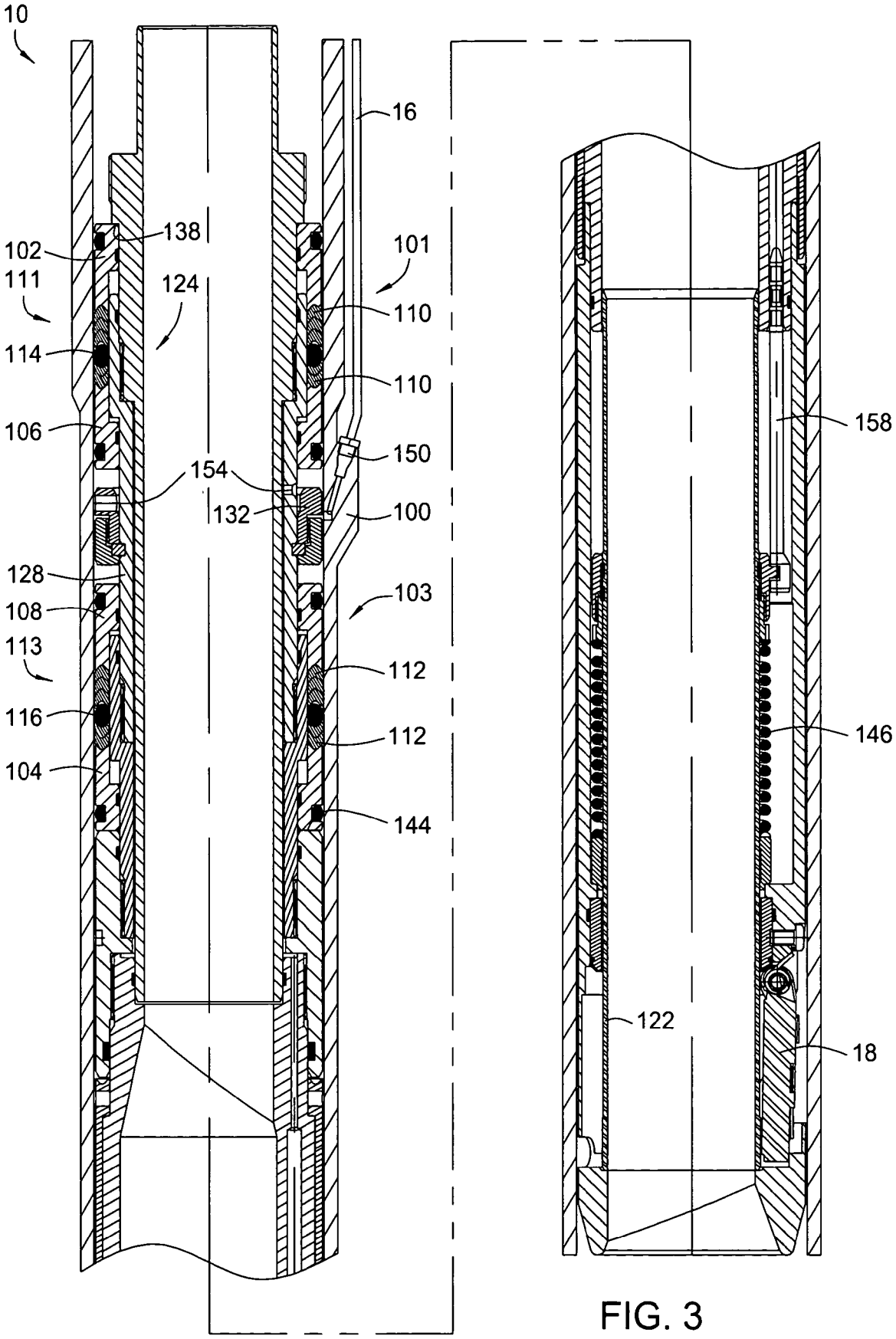
FIG. 3 is a sectional view of the SCSSV set in the nipple and actuated to an open position illustrating the seal assemblies in a first compressed position.

FIG. 3 is a sectional view of the SCSSV 10 in an actuated open position with the seal assemblies 101, 103 in a first compressed position. Fluid pressure supplied through the control line 16 to the port 150 in the nipple 100 passes through a fluid passageway 154 in the upper nut 132 and the middle sub 128 of the packing mandrel 124 into an annular area outside the upper sub 126. The fluid pressure acts on a piston rod 158 connected to a flow tube 122 to force the flow tube down against the bias of a biasing member such as a spring 146. The longitudinal displacement of the flow tube 122 causes the flow tube 122 to displace the flapper 18 and place the SCSSV 10 in the actuated open position. As an example of an SCSSV actuated by a concentric piston, the fluid pressure may alternatively act on an outward facing shoulder of a flow tube located concentrically within the packing mandrel to force the flow tube down and open a flapper.

The fluid pressure supplied through the control line 16 used to actuate and open the SCSSV 10 additionally operates to place the seal assemblies 101, 103 in the first compressed position. The fluid pressure supplied from the control line 16 enters the port 150 where the fluid enters the interior of the nipple 100 and acts on the second pistons 106, 108 to slide the second pistons toward the respective seals 111, 113. Any wellbore pressure on the first pistons 102, 104 is less than that on the second pistons 106, 108 such that the first pistons 102, 104 remain in contact with their respective decompression stops 138, 144. The sliding movement of the second pistons 106, 108 pushes on the chevrons 110, 112, which in turn pushes on the sealing members 114, 116. Compression of the seals 111, 113 caused by the sliding of the second pistons 106, 108 forces the sealing members 114, 116 and/or the chevrons 110, 112 into sealing contact with the inside surface of the nipple 100. Preferably, the sealing members 114, 116 are soft o-rings with a large cross section made from a material such as Viton® (65 duro). Additionally, the chevrons 110, 112 are preferably made from a material such as Kevlar® filled Viton®. Once the SCSSV is actuated open, wellbore fluid passes through the SCSSV 10 such that wellbore fluid pressure does not act to slide the first pistons 102, 104, and the first pistons 102, 104 remain in contact with their respective decompression stops 138, 144.

Figure 4:
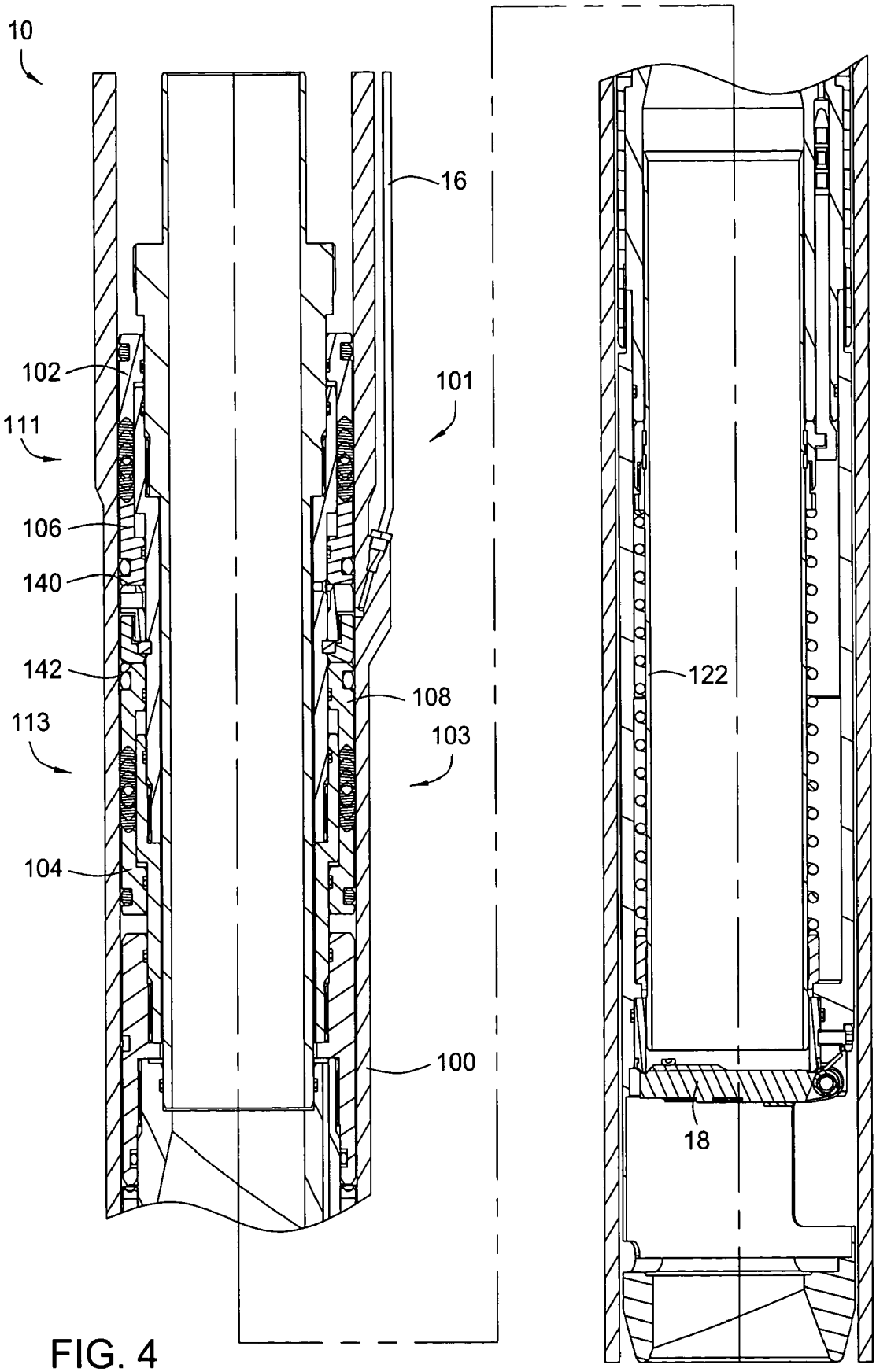
FIG. 4 is a sectional view of the SCSSV set in the nipple and biased to a closed position illustrating the seal assemblies in a second compressed position.

FIG. 4 is a sectional view of the SCSSV 10 set in the nipple 100 and biased to the closed position with the seal assemblies 101, 103 in a second compressed position and the flapper 18 blocking fluid flow through the SCSSV 10. As fluid pressure bleeds from the control line 16 during closure of the SCSSV 10, the fluid pressure acting on the second pistons 106, 108 approaches hydrostatic pressure, which along with the wellbore pressure acting on the first pistons 102, 104 keeps the seals 111, 113 compressed. When the wellbore pressure is greater than the pressure supplied by the control line 16, the wellbore pressure acts on the first pistons 102, 104 to slide the first pistons toward the respective seals 111, 113. For example, wellbore fluid pressure above the SCSSV 10 acts on the upper first piston 102, and wellbore fluid pressure below the SCSSV 10 acts on the lower first piston 104. The second pistons 106, 108 slide into contact with their respective decompression stops 140, 142. The sliding movement of the first pistons 102, 104 pushes on the chevrons 110, 112, which in turn pushes on the sealing members 114, 116. Therefore, compression of the seals 111, 113 caused by the sliding of the first pistons 102, 104 maintains sealing contact with the inside surface of the nipple 100 since the sealing members 114, 116 and/or the chevrons 110, 112 remain forced against the inside surface of the nipple 100.

In both the first and second compressed positions as illustrated by FIGS. 3 and 4 respectively, the upper and/or the lower seals 111, 113 form a fluid seal with an inside surface of the nipple 100 that may have irregularities, grooves, recesses, and/or ridges that would prevent prior SCSSVs from properly sealing within the nipple 100. Additionally, the sealing ability of the upper and/or the lower seals 111, 113 with the chevrons 110, 112 around the sealing members 114, 116 increases with increased pressure to the pistons 102, 106, 108, 104. As shown, the SCSSV provides a large inner diameter flow path, and the seal assemblies 101, 103 do not reduce or significantly reduce the inner diameter flow path through the SCSSV 10.

A method for sealing a SCSSV within a nipple located in a well is provided by aspects of the invention. The method includes locating the SCSSV in the nipple using conventional running methods. The SCSSV includes at least one seal assembly disposed about an outer surface thereof, and the at least one seal assembly includes a seal, a first piston disposed on a first side of the seal, and a second piston disposed on a second side of the seal. Urging the first piston, the second piston or both the first and second piston toward the seal forces the seal into sealing contact with an inside surface of the nipple. Urging the first piston is caused by wellbore fluid pressure applied to the first piston when the SCSSV is closed. Urging the second piston is caused by fluid pressure supplied from a control line to a fluid port in fluid communication with an inside portion of the nipple.

While the foregoing is directed to embodiments of the present invention, other and further embodiments of the invention may be devised without departing from the basic scope thereof, and the scope thereof is determined by the claims that follow.

The invention claimed is:

1. An assembly for setting in a tubular having a fluid port to an inside thereof, comprising:

a body; and at least one seal assembly, comprising:

a seal on an outer circumference of the body, the seal compressible against an inside surface of the tubular;

a first piston disposed on a first side of the seal and movable to compress the seal in response to a wellbore fluid pressure; and a second piston disposed on a second side of the seal and movable to compress the seal in response to the fluid pressure supplied to the fluid port.

2. The assembly of claim 1, wherein two seal assemblies are longitudinally spaced from each other on the body.

3. The assembly of claim 1, wherein the seal comprises a plurality of chevron seals on each side of a sealing element, the chevron seals oriented such that the sealing element is between concave portions of the chevron seals.

4. The assembly of claim 1, wherein the seal comprises a plurality of chevron seals on each side of an elastomer, the chevron seals capable of moving with the pistons to compress the elastomer and oriented such that the elastomer is between concave portions of the chevron seals.

5. The assembly of claim 1, wherein the tubular has an irregular inner diameter.

6. The assembly of claim 1, wherein the inside surface of the tubular has irregularities and the at least one seal assembly provides a fluid seal in the annular area between the assembly and the tubular.

7. The assembly of claim 1, wherein an outer diameter of the assembly is adapted to be received in the tubular.

8. The assembly of claim 1, wherein the tubular is a landing nipple.

9. The assembly of claim 1, wherein the body comprises a surface controlled, subsurface safety valve (SCSSV).

10. The assembly of claim 1, wherein the body comprises a valve.

11. The assembly of claim 1, wherein the body comprises a safety valve.

12. The assembly of claim 1 wherein two seal assemblies are longitudinally spaced from each other on the body, the two seal assemblies arranged to dispose the fluid port between the two seal assemblies when the assembly is set in the tubular.

13. The assembly of claim 1 wherein the body comprises a safety valve having a closing member operated by an actuator responsive to a fluid pressure supplied to the fluid port.

14. A method for sealing a member in a bore of a tubular located in a well, comprising:

locating the member in the bore, the member having at least one seal assembly disposed about an outer surface thereof, wherein the at least one seal assembly includes a seal, a first piston disposed on a first side of the seal, and a second piston disposed on a second side of the seal; and urging either the first piston, the second piston or both the first and second piston toward the seal to force the seal into sealing contact with an inside surface of the bore.

15. The method of claim 14, wherein urging the first piston is caused by wellbore fluid pressure applied to the first piston.

16. The method of claim 14, wherein urging the second piston is caused by fluid pressure supplied from a fluid port in fluid communication with an inside portion of the bore.

17. The method of claim 14, wherein the seal comprises a plurality of chevron seals on each side of a sealing element, the chevron seals oriented such that the sealing element is between concave portions of the chevron seals.

18. The method of claim 14, wherein the member comprises a safety valve and locating the safety valve in the bore comprises running the safety valve in the well on a wire line and setting the safety valve in the bore.

19. The method of claim 14, wherein two seal assemblies are longitudinally spaced from each other on the member.

20. The method of claim 14, further comprising sealing an annulus on each side of a fluid port in fluid communication with an inside portion of the bore with two seal assemblies.

21. An assembly for setting a safety valve in a well, comprising:

a tubular member located in the well and having a bore adapted to receive the safety valve; and at least one seal assembly on the safety valve, the at least one seal assembly comprising:

a seal on an outer circumference of the safety valve;

a first piston disposed on a first side of the seal and movable to force the seal into sealing contact with an inside of the bore in response to wellbore fluid pressure; and a second piston disposed on a second side of the seal and movable to force the seal into sealing contact with the inside of the bore in response to a fluid pressure supplied from a control line.

22. The assembly of claim 21, wherein two seal assemblies are longitudinally spaced from each other on the safety valve.

23. The assembly of claim 21, wherein the seal comprises a plurality of chevron seals on each side of a sealing element, the chevron seals oriented such that the sealing element is between concave portions of the chevron seals.

24. The assembly of claim 21, wherein the seal comprises a plurality of chevron seals on each side of an elastomer, the chevron seals capable of moving with the pistons to compress the elastomer and oriented such that the elastomer is between concave portions of the chevron seals.

25. The assembly of claim 21, wherein the bore has an irregular inner diameter.

26. The assembly of claim 21, wherein the inside surface of the bore has irregularities and the at least one seal assembly provides a fluid seal in the annular area between the safety valve and the tubular member.

* * * * *

UNITED STATES PATENT AND TRADEMARK OFFICE

CERTIFICATE OF CORRECTION

PATENT NO. : 7,055,607 B2
APPLICATION NO. : 10/779478
DATED : June 6, 2006
INVENTOR(S) : Jean-Luc Jacob and Franck Lavie It is certified that error appears in the above-identified patent and that said Letters Patent is hereby corrected as shown below:

On the Cover of the Patent

In Section (75), please include the following second inventor: Franck Lavie, Mimizan (FR).

Signed and Sealed this

Thirtieth Day of January, 2007

JON W. DUDAS
*Director of the United States Patent and Trademark Office*